United States Patent [19]

Horst

[11] 4,363,271

[45] Dec. 14, 1982

[54] PATTERN REGISTRATION CONTROL BARS

[75] Inventor: Robert L. Horst, Lancaster, Pa.

[73] Assignee: Armstrong World Industries, Inc., Lancaster, Pa.

[21] Appl. No.: 183,004

[22] Filed: Sep. 2, 1980

Related U.S. Application Data

[63] Continuation-in-part of Ser. No. 40,033, May 17, 1979, abandoned.

[51] Int. Cl.[3] ..... B41F 13/24

[52] U.S. Cl. ..... 101/181; 101/248; 250/548

[58] Field of Search ..... 354/11; 250/548, 557; 101/181, 248

[56] References Cited

U.S. PATENT DOCUMENTS

| | | | |
|---|---|---|---|
| 3,513,320 | 5/1970 | Weldon | 250/548 |
| 3,594,581 | 7/1971 | Yamashita | 250/557 |
| 3,710,707 | 1/1973 | Hansen et al. | 345/11 |
| 3,915,090 | 10/1975 | Horst et al. | 101/181 |
| 4,167,677 | 9/1979 | Suzki | 250/548 |

FOREIGN PATENT DOCUMENTS

| | | | |
|---|---|---|---|
| 118467 | 8/1970 | Denmark | 101/181 |
| 2549530 | 5/1977 | Fed. Rep. of Germany | 101/181 |
| 54-47901 | 1/1979 | Japan | 101/181 |
| 7808954 | 3/1980 | Netherlands | 101/181 |
| 786120 | 11/1957 | United Kingdom | 250/557 |

*Primary Examiner*—William Pieprz

[57] ABSTRACT

A particular type of registration control mark is utilized with a conventional pattern registration control system for the purpose of controlling registration between a printed pattern and an embossed pattern. The pattern registration control mark will develop signature bursts which are unique due to the design of the pattern registration control mark.

1 Claim, 6 Drawing Figures

PATTERN REGISTRATION CONTROL BARS

CROSS-REFERENCE TO RELATED APPLICATION

This application is a continuation in part of U.S. application Ser. No. 40,033 filed May 17, 1979, now abandoned in the name of Robert L. Horst and entitled "Pattern Registration Control Marks."

BACKGROUND OF THE INVENTION

The invention is directed to, but not limited to, a pattern registration control mark for use with an embossing process for a pattern printed sheet and, more particularly an apparatus which will secure registration between a patterned embossing roll and a similar preprinted pattern on a web.

DESCRIPTION OF THE PRIOR ART

U.S. Pat. No. 3,915,090 discloses a pattern registration control system which is particularly adaptable for use with the pattern registration control marks herein. It is noted that in that patent, a single line mark 7 is used.

U.S. Pat. No. 3,711,353 is another pattern registration control system wherein the mark used to control the system is mark 55, and it is composed of three uniformly spaced, uniform width marks.

U.S. Pat. Nos. 3,711,353 and 3,446,978 along with German Patent DAS No. 1002363 are further examples of registration marks in which plural lines are used but the lines are all of a common width.

SUMMARY OF THE INVENTION

The invention herein is directed to a control mark composed of a pattern of plural indicator bars. The bars are variable in width and/or the bars are variable in their spacing. The mark is particularly adaptable for use with the registration system of U.S. Pat. No. 3,915,090 but need not be particularly restricted to use with the system, and could be used with any patterning system requiring registration control, such as embossing, sheeting, printing and punching operations.

DESCRIPTION OF THE PREFERRED EMBODIMENT

Figure 1:
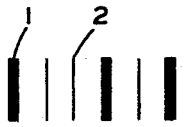
FIG. 1 of the drawing is a sample of a bar pattern or registration control mark which has bars variable in width.
Figure 2:
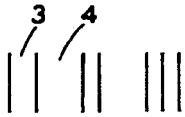
FIG. 2 is an illustration of a mark pattern wherein the bars are variable in spacing.
Figure 3:
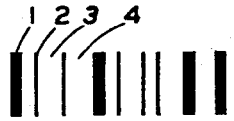
FIG. 3 is a mark pattern wherein the bars are variable both in their width and their spacing.

The invention herein is primarily directed toward a bar pattern or a registration control mark. One embodiment of the bar pattern is shown in FIG. 1 wherein the bars 1 are thicker than the bars 2; and therefore, there is provided bars which are variable in width. In FIG. 2 there is shown another embodiment wherein the bars are all of the same width, but the spacing 3 varies in size from the spacing 4, and therefore, there is provided a variable in the spacing between adjacent bars. Finally, in FIG. 3 there is shown a combination of FIGS. 1 and 2 wherein the bars 1 and 2 are of variable widths, and the spacings 3 and 4 are variable, so there is now provided the combination of bars of variable width with variable spacing between bars. These bar patterns may be continuous or intermittent. That is, the bar patterns may be intermittent in nature and be in position on the edge of a web just at the beginning of each repeat preprinted pattern or they may be spaced periodically along a repeat preprinted pattern. The pattern within each bar pattern can be the same or varied. For example, the bar pattern at the beginning of the web preprinted pattern could be of one particular spacing and width. The bar pattern at the middle of the web preprinted pattern could be of a different width and spacing configuration. In addition, the bar pattern could be continuous along the whole length of the web preprinted pattern and could be a continuously varying spacing and width arrangement so that the bar pattern continuously varies along the whole length of the web preprinted pattern.

The invention herein is particularly adaptable for use in the structure of U.S. Pat. No. 3,915,090. The mark or bars will be sensed by the photosensor 14 which will be scanning the web containing the bars, and this will be used to provide the signatures which are used for registration control.

Figure 4:
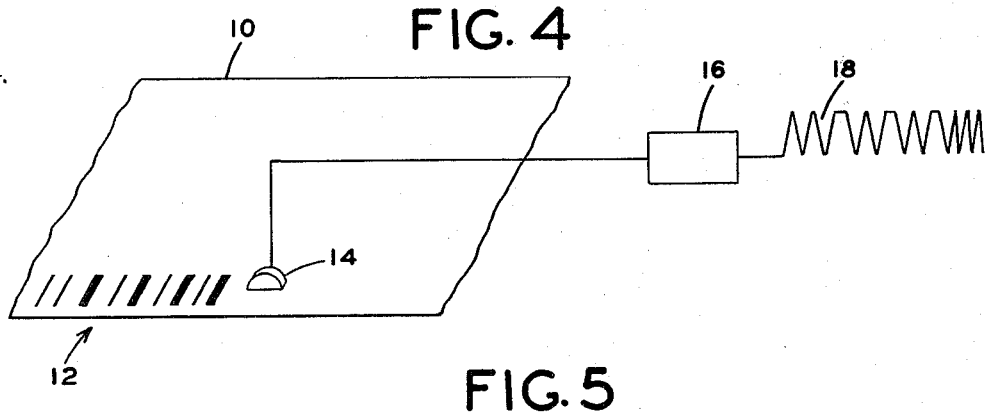
FIG. 4 is a prospective view of a bar pattern being sensed.
Figure 5:
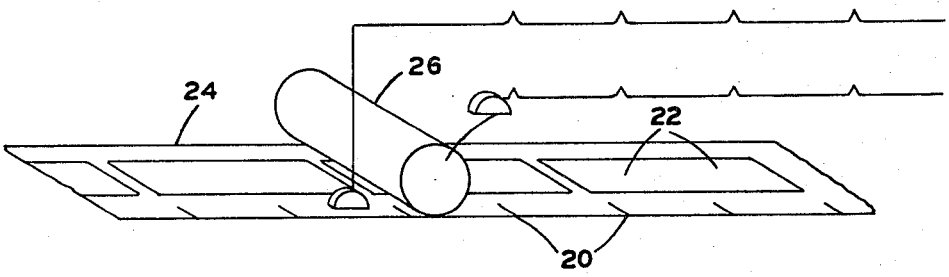
FIG. 5 is a showing of a conventional registration system using single line spaced marks.

FIG. 4 shows a broad application of the invention herein wherein a sheet 10 is provided with a bar pattern or pattern registration control marks 12 which is sensed by sensor 14. The photosensor 14 is sensitive to variations in light and converts these variations into electrical impulses. The impulses are then translated and sent to an amplifier 16 which provides an electrical impulse signature of the bars. The impulse appears as the signature 18. This can be used in the structure of U.S. Pat. No. 3,915,090, or in any other type of registration control system wherein the fit between the pattern impulse signature and a reference signature is the basis for registration error measurements and/or error correction. Referring now to FIG. 5 there is noted the conventional registration control system which usually has a series of registration marks 20 positioned normally only at the beginning of each of the web preprinted patterns 22 which one is to print in registration with or if a pattern 22 was 36" long maybe there would be a mark 20 every 9". It can be seen that the sensor for the patterning roll and the sensor for the patterned web will sense the individual marks and provide the spiked signature shown. Should the plurality of marks be provided every 9" on a 36" prepatterned web, it is possible that one could be off by 9" between the prepatterned web 24 and the patterning roll 26 and the signals match up yet be 9" out of registration.

Figure 6:
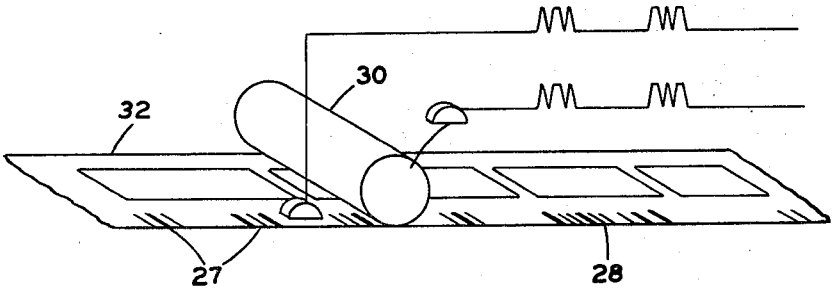
FIG. 6 is a showing of the inventive system herein in use.

In FIG. 6 there is shown the invention herein wherein the variable width spacing registration mark is provided either at the beginning of each pattern or as variations thereof could be provided every 9" on a 36" with each of the bars 27 at 9, 18, 27 inches being of a different pattern in width and spacing so that even if one was 9" off the signatures would not match up. This is shown in FIG. 6. Naturally, the registration pattern could be continuous along the whole length of the prepatterned web and thus provide a very definite signature of each pattern with the bar registration mark 20 being such that there could only be match-up in the pattern between the patterning roll 30 and the prepattern web 32 when there is exact registration.

It should be noted that the state of electronics is such that today both scanners need not be positioned the same distance from the embossing point. A signal delay circuit or a phase initialization adjustment on the registration system may be the full equivalent of the positioning requirement.

What is claimed is:

1. An apparatus for controlling the register between a pattern about to be placed upon a web of material and a pattern which is already existing on the web of material, the pattern which is to be placed upon the web of material to be placed thereon in register with the preexisting pattern comprising:

(a) a means for moving a web of material, (b) a preexisting pattern with a registration marking on the web of material and a new pattern with the same registration marking on a rotary means for applying the new pattern in registration with the preexisting pattern, (c) a scanner means for scanning the registration markings, (d) said registration markings being a variable bar mark composed of a plurality of variable width parallel bars of variable spacing between the bars, (e) said variable bar mark being provided at least at the beginning of the preexisting pattern and the new pattern, with both patterns being of the same repeat length and the mark being set forth in arrangement only once on the periphery of the rotary pattern applying means such that there can only be match-up in the registration marks when the pattern to be placed on the web of material and the preexisting pattern are in exact registration, and (f) means connecting the scanning means and the means moving the web so that the registration markings sensed may affect the means moving the web for controlling register.

* * * * *